United States Patent [19]

Koudstaal et al.

[11] 4,400,910

[45] Aug. 30, 1983

[54] METHOD FOR PROTECTING PLANTS DURING TRANSPORTATION BY PACKAGING AND ARTICLE

[75] Inventors: Willem Koudstaal, Vinkeveen, Netherlands; William J. Organ, Petersfield, England

[73] Assignee: Koninklijke Emballage Industrie Van Leer B.V., Amstelveen, Netherlands

[21] Appl. No.: 256,397

[22] Filed: Apr. 22, 1981

[30] Foreign Application Priority Data

Apr. 25, 1980 [NL] Netherlands ..... 8002435

[51] Int. Cl.[3] ..... A01G 9/02; A01G 5/06

[52] U.S. Cl. ..... 47/84; 47/DIG. 7

[58] Field of Search ..... 47/84, DIG. 7

[56] References Cited

U.S. PATENT DOCUMENTS

| | | | |
|---|---|---|---|
| 3,824,998 | 7/1974 | Snyder | 128/132 X |
| 3,869,828 | 3/1975 | Matsumoto | 47/84 |
| 4,006,561 | 2/1977 | Thoma | 47/58 |
| 4,118,890 | 10/1978 | Shore | 47/84 |
| 4,189,868 | 2/1980 | Tymchuck et al. | 47/84 |

FOREIGN PATENT DOCUMENTS

| | | |
|---|---|---|
| 7201475 | 8/1982 | Netherlands . |
| 2018114 | 10/1979 | United Kingdom . |

OTHER PUBLICATIONS

W. C. Boer and Ing. H. Hatkema, "Snijbloemen in Opblaasverpakking", published in Vakblad voor de Bloemisterij, 50/51 (1977) on pp. 52, 53.

*Primary Examiner*—Steven A. Bratlie

*Attorney, Agent, or Firm*—Brumbaugh, Graves, Donohue & Raymond

[57] ABSTRACT

The invention relates to a method for protecting plants during transportation by packaging plant (2) and its pot (1) in a bag (3) which at least partly consists of microporous material (6) having preferably an air-permeability of 0.1–300 $mm^3$ air per second per Pascal per $m^2$ of the film material with pore diameters of less than 0.5 $\mu m$ due to which the bag (3) is self-inflatable, exchange of gases still takes place and the climate within the bag (3) is kept constant.

3 Claims, 2 Drawing Figures

METHOD FOR PROTECTING PLANTS DURING TRANSPORTATION BY PACKAGING AND ARTICLE

The invention relates to a method for protecting plants during transportation by packaging, in which the plants are packaged in a closed enclosure from a film surrounding the plants entirely, in which a slight overpressure prevails and in which the plants are provided with sufficient moisture and/or nutritious substances.

The term "plants" is used herein to describe plants having their roots in a clod of soil or a similar material, said clod in one way or another being kept together as by a pot. In other words, each plant has its own matrix; cut-flowers are not included within the meaning of the term.

From the published British Patent Application No. 2,018,114 it is known to package plants in a substantially impervious plastic film material. Said package is inflated shortly before sealing by injecting air. By said inflation the plants positioned in the inflated package can be protected against damage. Said inflation becomes a serious complication during packaging. Further, said inflation does not result in bulging of the package. Consequently, the inflation effect is comparative and disappears after some time period in connection to the "leakage" of the film. The film used for said package is transparent. However, said transparency may be impaired by condensation of the moisture in the bag.

With the package disclosed in the British application a protected long distance transportation is possible and a reasonably good preservation of the plants is achieved. In practice, however, it appears that the quality of the plants in the package deteriorates sooner than desired. This happens because a very high relative humidity prevails in the entirely closed package, keeping the film continuously wet. The leaves of the plants come in contact with the wet film and spoil. Moreover, the condensation is such that the presentation of the plant at the selling place is not acceptable.

If phanerogamic plants are of interest ethylene gas is produced by which the flower perishes.

The object of the invention is to provide for a method by which all said problems are eliminated.

According to the invention said object is achieved by packaging the plants in an enclosure consisting at least partly of a microporous film.

By a microporous film is meant a film, the porosity of which is substantially lower than that of normal paper, but substantially higher than that of normal plastic foils. Air-permeability of said film may amount to between 0.1 and 300 $mm^3$ air per second Pascal per $m^2$ of the film. The pore diameter of said film may not be more than 0.5 and preferably smaller than 0.2 $\mu m$. The maximum porosity in this range is yet still substantially beneath the minimum porosity of paper, whereas the minimum lies far beyond that of plastic film.

Such a film is moisture and air pervious but does not pass bacteria.

A microporous film having these characteristics is known per se, for example from the U.S. Pat. No. 3,824,998. An enclosure consisting of such a film has the property to inflate itself when in the interior moisture is present. Potted plants contain moisture in the soil in the pot in which the plant is positioned.

The microporous film may and will usually consist of a suitable plastic being treated such that the desired rate of porosity is obtained. However, it is also thinkable that the film consists of a paper covered with another material such that the naturally too high porosity is diminished to the microporosity range.

The microporous packaging described herein permits an exchange between ethylene gas in the package and air from outside. Moisture may pass from the interior to the outside, but so slowly that drying-up does not take place soon and the humidity is not too high. This is an important advantage both with respect to an open package and with respect to the entirely sealed package.

In essence a continuous refreshment of the air occurs in the package without the possibility of bacteria penetration.

Thus, with the invention it is possible to position potted plants well groomed in a usual way in a bag consisting at least partly of a microporous film and to seal said bag. After a short time period the bag inflates itself and provides for the desired protection. Microporous film has the property to be milky white, i.e. not transparent. Now, if one makes the package partly from microporous film and for the rest from an impervious but transparent plastic film it appears that by the properties of the microporous film in the package no condensate is produced on the translucent portion of the package so that the plant is well visible.

Thus, it appears that the climate within the bag remains favourable much longer for the plant. A preservation of a plurality of months is possible without any disadvantageous alteration and without care. The complicated inflation step with the associated disadvantages is eliminated as well as the necessity for having available the necessary skill for the inflation in order to do this well.

It is noted that from the article "Snijbloemen in opblaasverpakking" of W. C. Boer and Ing. H. Hatkema of the Sprenger Instituut, Wageningen, published in "Vakblad voor de Bloemisterij"-50/51 (1977) on pages 52, 53 it is known to package cut-flowers in bags of plastic foil having self-inflating properties, said self-inflating effect one obtains by adding a quantity of water to the bag before sealing it. The protection by the aircushion against shock damage is known from said article. Said type of package has not proved to be successful. Condensation and fungoid growth appeared although to a less extent than in the entirely sealed package and the protecting function by the inflation effect was considered as an inconvenience because thereby, the cut-flowers occupy a much larger volume.

Said package being not a success for cut-flowers may be explained by the fact that cut-flowers are in essence a dead product and the transportation thereof is usually carried out in cooled spaces. The cooling oppresses the build-up of sufficient vapour tension so that the inflation effect gets lost or is insufficient.

It is surprising that in packaging potted plants said problems do not arise, while the problem of volume does not appear because pot plants are not, such as cut-flowers, piled up in lying relation during the transport.

In the drawing an embodiment of a package according to the invention is illustrated.

Figure 1:
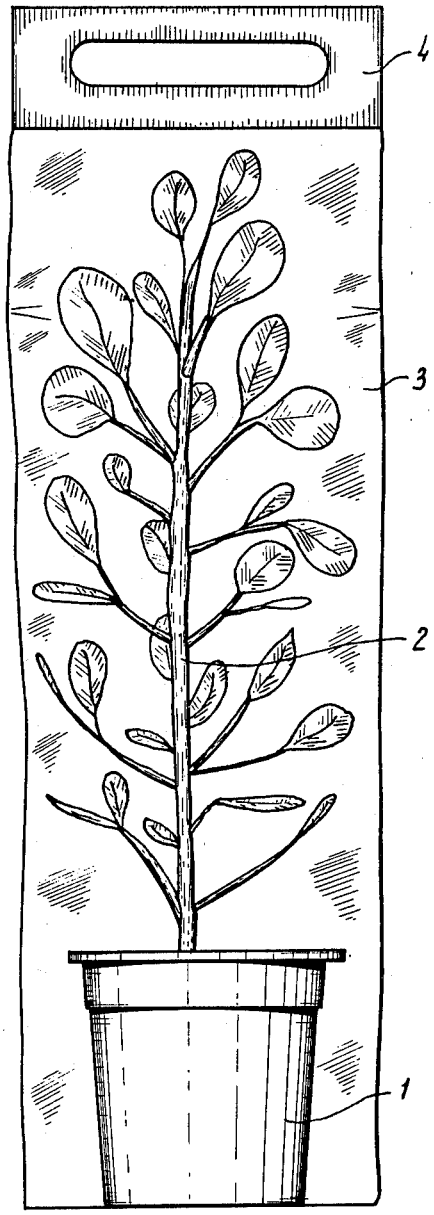
FIG. 1 shows a package in front elevation.

FIG. 1 shows a pot 1 with a plant 2 located in a plastic bag 3 having a sealed or clamped handgrip 4.

Figure 2:
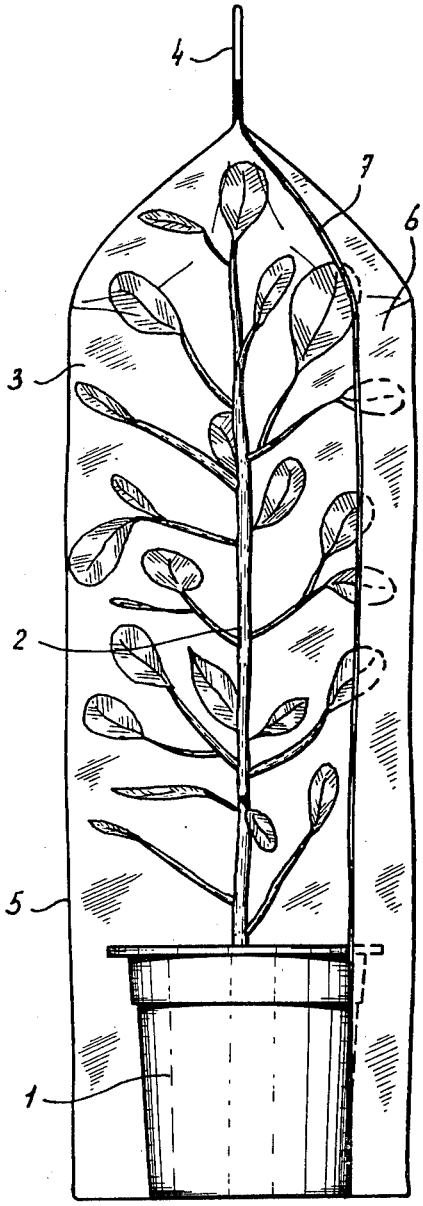
FIG. 2 shows a package in side elevation.

FIG. 2 shows that the front of the bag consists of a translucent foil 5 and the rear-side of the non-translucent microporous foil 6. The foils 5 and 6 are sealed at 7.

Potted plants packaged in this way may be placed vertically in any number, for example six or more, in boxes suitable for transportation. The inflated bags bear against the walls of the box as well as against each other.

In order to display the plant for sale, one only needs to take them out of the box and to put them down at the destination location. The buyer may see what he buys because the transparency of the package is entirely preserved and the package needs to be removed from the plant only when the plant has reached its final destination. Because moisture and eventually ethylene gas are exchanged with air through the microporous layer, the composition of the atmosphere within the bag remains optimal so that the plant reaches its destination in a unaltered condition after a long time period after the beginning in the package.

Synthetic polymeric film materials such as polypropylene and polyethylene are considered suitable for the microporous material of the present invention; in particular, polypropylene is preferred. Film of the required porosity may be obtained by adding to the thermoplastic film polymer a comparitively high quantity of fine distributed inert film material and after extruding the film to stretch this and to subject it to a heat treatment. By stretching, the micropores are formed, in which the filler material produces said forming. For polypropylene, 40 up to 50 weight % of the mixture may consist of filler material. Calcium corbonate represents a suitable inert filler. Other fillers may be barium sulphate or china clay. In connection with the high percentage of filler material, it is preferable to cover the film with a lubricant such as calcium stearate.

In the stretching steps stretching ratios of 1.8 up to 4.5 and temperatures of 20° up to 100° C. are considered. After stretching, a heat treatment takes place at a temperature above the stretching temperature and with a tension control in order to bring about a controlled shrinkage. The heat treatment stabilizes the film against shrinkage when heating occurs. For example, this may be the case in sterilization of the film. Shrinkage that occurs during sterilization may result in an undesired diminishment of the porosity. By a suitable selection of the conditions in the heat treatment, such as temperature and time, one can control the contraction and thereby the porosity of the final product.

The added table below shows by way of examples a suitable range of conditions for treating a polypropylene having a low melt index and reveals the features of the microporous film thus obtained.

| | |
|---|---|
| Polymer weight percentage | 25–60 |
| Filler type | $CaCO_3$ |
| weight percentage | 35–60 |
| Stretching ratio | 1.8–4.5 |
| Stretching temperature | 20–100° C. |
| Heat treatment temperature | 70–145° C. |
| Allowed contraction during heat treatment | 0–25% |
| Permeability ($mm^3$ air/sec/Pascal/$m_2$) | 0.1–300 |
| *Percentage shrinkage at sterilisation | 1–28% |
| Remaining permeability | 0.5–150 $mm^3$ |
| *After sterilisation | |
| Mean pore dimension | 0.2–0.5 μm |
| Rate of self-inflatability | slow–quick |

*Sterilisation takes place at heating the film at 130° C. for one hour.

We claim:

1. A method for protecting potted plants during transport which comprises the steps of (a) enclosing the potted plant including soil with moisture and nutrients for said plant in a flexible and sealable package comprising a microporous film portion and a second portion of a transparent substantially impervious plastic film, the microporous film having an air-permeability of 0.1 to 300 $mm^3$ air per second per Pascal per $m^2$ of the film with pore diameters smaller than 0.5 μm, and the package being self-inflating within a short time after sealing due to evaporation of the moisture supplied by the potted plant, (b) sealing the package, and (c) permitting the package to self-inflate.

2. An article of manufacture comprising a potted plant including soil with moisture and nutrients for said plant and a package surrounding said potted plant, the package comprising a sealable flexible package, one portion of which is a microporous film having an air-permeability of 0.1 to 300 $mm^3$ air per second per Pascal per $m^2$ of the film with pore diameters smaller than 0.5 μm, and another portion of which is a transparent substantially impervious plastic film, the package being self-inflating within a short time after sealing due to evaporation of the moisture supplied by the potted plant.

3. The article of claim 2, wherein the microporous film portion of the package forms the rear side of the package and the balance of the package is transparent substantially impervious plastic film.

* * * * *